US008781372B2

(12) United States Patent
Nagashima

(10) Patent No.: US 8,781,372 B2
(45) Date of Patent: Jul. 15, 2014

(54) IMAGE FORMING APPARATUS AND TONER CONTAINER

(75) Inventor: Teruhiko Nagashima, Osaka (JP)

(73) Assignee: Kyocera Document Solutions Inc. (JP)

( * ) Notice: Subject to any disclaimer, the term of this patent is extended or adjusted under 35 U.S.C. 154(b) by 244 days.

(21) Appl. No.: 13/446,249

(22) Filed: Apr. 13, 2012

(65) Prior Publication Data

US 2012/0263504 A1 Oct. 18, 2012

(30) Foreign Application Priority Data

Apr. 15, 2011 (JP) ..... 2011-091319

(51) Int. Cl.
*G03G 15/08* (2006.01)

(52) U.S. Cl.
USPC ..... 399/258; 399/263

(58) Field of Classification Search
CPC ..... G03G 15/0832; G03G 15/0834; G03G 15/0836; G03G 15/0837; G03G 15/0865; G03G 15/0867; G03G 15/0868; G03G 15/087; G03G 15/0872; G03G 21/1857; G03G 21/1864; G03G 2215/066; G03G 2215/0663; G03G 2215/0665
USPC ..... 399/258, 262, 263; 222/DIG. 1
See application file for complete search history.

(56) References Cited

U.S. PATENT DOCUMENTS 5,345,297 A 9/1994 Katakabe et al.
5,909,610 A 6/1999 Yoshiki et al.
6,418,290 B1 7/2002 Isomura et al.
7,369,798 B2 * 5/2008 Sasae et al. ..... 399/262
8,385,773 B2 * 2/2013 Awano ..... 399/110
2009/0035024 A1 2/2009 Sato
2012/0177405 A1 7/2012 Sato

FOREIGN PATENT DOCUMENTS

JP 6-186844 7/1994
JP 7114256 5/1995
JP 2000-315007 11/2000
JP 2001-235933 8/2001
JP 2009175759 A * 8/2009

* cited by examiner

*Primary Examiner* — Robert Beatty
(74) *Attorney, Agent, or Firm* — Gerald E. Hespos; Michael J. Porco; Matthew T. Hespos

(57) ABSTRACT

A toner container includes container main body, conveying screws and container gear. A developing device includes developer housing including container mounting portion, gear holder including output gear which rotates upon receiving rotational drive force from motor and displaceable to engaged position where the output gear is engaged with the container gear and retracted position retracted outward from the engaged position, and biasing spring. The container main body includes a second pressing plate and the gear holder includes a contact portion with which the second pressing plate comes into contact. The second pressing plate and the contact portion displace the gear holder from the engaged position to the retracted position as the toner container moves in a mounting process. When the toner container reaches a predetermined assembled position, the gear holder is returned to the engaged position by a biasing force of the biasing spring.

7 Claims, 9 Drawing Sheets

IMAGE FORMING APPARATUS AND TONER CONTAINER

This application is based on Japanese Patent Application Serial No. 2011-091319 filed with the Japan Patent Office on Apr. 15, 2011, the contents of which are hereby incorporated by reference.

BACKGROUND

The present disclosure relates to an image forming apparatus including a developing device for developing an electrostatic latent image formed on a photoconductor with toner and a toner container for storing toner and supplying the toner to the developing device, and the toner container.

There is known an image forming apparatus such as a printer in which a developing device is arranged around a photoconductive drum and an electrostatic latent image formed on the photoconductive drum is developed with toner by this developing device. A toner container is removably assembled with the developing device, and toner is supplied from the toner container to the developing device as the toner decreases in amount.

Note that a conventional developing device includes a developing roller and a plurality of conveying screws extending in parallel to each other, and a long and narrow housing enclosing the developing roller and the like. On the other hand, a toner container includes a case long and narrow along a longitudinal direction of the developing device and an agitating shaft and a conveying screw arranged in this case. The toner container is assembled with the housing of the developing device from above with the agitating shaft and the like held in parallel to the developing roller. By this assembling operation, an input gear mounted on the agitating shaft of the toner container is engaged with an output gear of the developing device and a rotational drive force is transmitted from the developing device to the toner container to rotate the agitating shaft and the like.

In an image forming apparatus including such a conventional developing device and the like, it has been necessary to largely open an upper part of the image forming apparatus in mounting or removing the toner container and mount or remove the toner container by accessing deep into the apparatus. In recent years, in terms of improving the mountability and removability of a toner container, it is thought to adopt a structure which enables the toner container to be mounted and removed in a horizontal direction, for example, in an open state of a front cover without largely opening an upper part of an image forming apparatus.

In this case, if it is particularly necessary in view of the layout or the like, an output gear rotatable about an axis extending in an assembling direction of the toner container with the developing device, i.e. a horizontal direction perpendicular to a developing roller is arranged in the developing device and then an input gear is so arranged in the toner container as to be engageable with the output gear. In such a structure, unless the positions of the teeth of the output gear and the input gear are proper, the input gear interferes with the output gear in assembling the toner container with the developing device, thereby making it considerably difficult to assemble the toner container with the developing device. There is also a possibility of damaging the both gears. Thus, this point is required to be solved.

The present disclosure was developed in view of such a situation and an object thereof is to avoid the interference of an output gear of a developing device and an input gear of a toner container and enable the toner container to be quickly assembled with the developing device.

SUMMARY

One aspect of the present disclosure is directed to an image forming apparatus, comprising an image bearing member (31) for bearing a toner image on a circumferential surface, a developing device (33) including a developing roller (331) for supplying toner to the circumferential surface of the image bearing member (31), and a toner container (50) to be removably assembled with the developing device for supplying toner to the developing device.

The toner container (50) is assembled with the developing device (33) along an assembling direction perpendicular to an axial direction of the developing roller (331) and includes a container main body (51) in which the toner is contained, a rotating member (52) which is arranged in the container main body (51) and rotatably supported in the container main body (51), and an input gear (52G) which is provided rotatably about an axis parallel to the assembling direction and to which a rotational drive force for rotating the rotating member (52) is to be input.

The developing device (33) includes a housing main body (60) in which the developing roller is housed, a container mounting portion (61) which is arranged on the housing main body and to which the toner container is to be mounted, a movable member (65) which includes an output gear (651) which rotates about an axis parallel to the assembling direction upon receiving a rotational drive force from outside and is so supported on the housing main body (60) as to be displaceable to a first position (FIG. 10) where the input gear (52G) and the output gear (651) are engageable and a second position (FIG. 9) retracted outward from the first position, and a biasing member (68) which biases the movable member (65) to the first position.

The container main body (51) includes a container side contact portion (544), the movable member (65) includes a movable member side contact portion (653), and the container side contact portion (544) comes into contact with the movable member side contact portion (653) in a mounting process of mounting the toner container (50) to the container mounting portion (61) of the developing device (33); the container side contact portion (544) comes into contact with the movable member side contact portion (653) in the mounting process, thereby displacing the movable member (65) from the first position (FIG. 10) to the second position (FIG. 9) against a biasing force of the biasing member (68) as the toner container (50) moves in the assembling direction; and when the toner container (50) reaches a predetermined assembled position, the movable member (65) is returned to the first position (FIG. 10) by the biasing force of the biasing member (68).

Another aspect of the present disclosure is directed to a container to be mounted to a developing device. The developing device includes a developing roller (331) for supplying toner to a circumferential surface of an image bearing member (31) bearing a toner image on the circumferential surface, and a toner container (50) is removably mountable to the developing device along an assembling direction perpendicular to an axial direction of the developing roller (331). The developing device further includes a housing main body (60) which includes a container mounting portion (61) to which the toner container (50) is to be mounted; a movable member (65) which includes an output gear (651) which rotates about an axis parallel to the assembling direction upon receiving a rotational drive force from outside and is so supported on the housing main body (60) as to be displaceable to a first position where the output gear (651) transmits the rotational drive force to the toner container and a second position retracted outward from the first position, and a biasing member (68) which biases the movable member (65) to the first position. The toner container (50) to be assembled with the above developing device comprises a container main body (51) in which the toner is contained; a rotating member (52) which is arranged in the container main body (51) and rotatably supported in the container main body; and an input gear (52G) which is provided rotatably about an axis parallel to the assembling direction and engageable with the output gear (651) of the movable member (65) arranged at the first position and to which a rotational drive force for rotating the rotating member by the engagement of the input gear with the output gear (651) is to be input from the output gear (651). The container main body (51) includes a contact portion (544) which comes into contact with the movable member (65) in a mounting process of mounting the toner container to the container mounting portion (61); the contact portion (544) displaces the movable member from the first position (FIG. 10) to the second position (FIG. 9) against a biasing force of the biasing member (68) as the toner container (50) moves in the assembling direction in the mounting process; and when the toner container (50) reaches a predetermined assembled position, the movable member (65) is returned to the first position (FIG. 10) by the biasing force of the biasing member (68).

These and other objects, features and advantages of the present disclosure will become more apparent upon reading the following detailed description along with the accompanying drawings.

DETAILED DESCRIPTION

Figure 1:
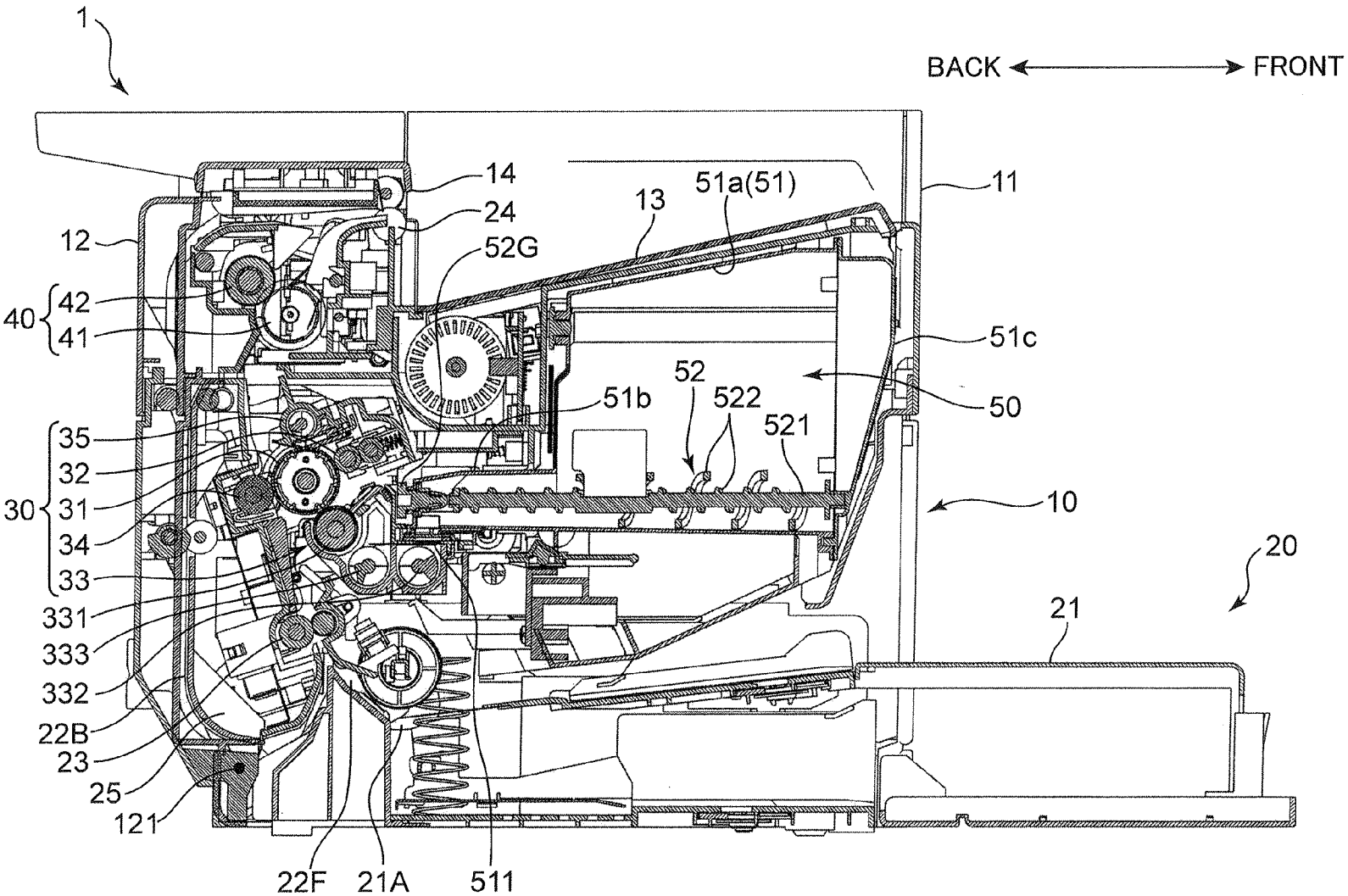
FIG. 1 is a sectional view showing the internal structure of an image forming apparatus according to one embodiment of the present disclosure.

Hereinafter, an embodiment of the present disclosure is described in detail based on the drawings. FIG. 1 is a sectional view showing the internal structure of an image forming apparatus 1 according to one embodiment of the present disclosure. Although a black-and-white printer is illustrated as the image forming apparatus 1 here, the image forming apparatus may be a copier, a facsimile machine or a complex machine provided with these functions or may be an image forming apparatus for forming a color image.

The image forming apparatus 1 includes a main housing 10 having a substantially rectangular parallelepipedic housing structure, a feeding unit 20, an image forming unit 30, a fixing unit 40 and a toner container 50 housed in the main housing 10.

The main housing 10 includes a front cover 11 on the front side (right side of FIG. 1) and a rear cover 12 on the rear side. A user can take out the toner container 50 from the front side of the main housing 10 by opening the front cover 11 when toner runs out. The rear cover 12 is a cover which is opened at the time of a sheet jam and maintenance. The respective units such as the image forming unit 30 and the fixing unit 40 can be taken out from the rear side of the main housing 10 by opening the rear cover 12. Further, a sheet discharge unit 13 to which a sheet after image formation is to be discharged is provided on the upper surface of the main housing 10.

The feeding unit 20 includes a sheet cassette 21 for storing sheets on which an image forming operation is to be performed. This sheet cassette 21 can be withdrawn forward from the front side of the main housing 10. The sheet cassette 21 includes a sheet storage space where a stack of sheets is stored, a lift plate for lifting up the stack of sheets for sheet feeding, and the like. A sheet feeding portion 21A is provided above the rear end of the sheet cassette 21. A pickup roller (not shown) for picking up the uppermost sheet of the sheet stack in the sheet cassette 21 one by one is arranged in this sheet feeding portion 21A.

The image forming unit 30 performs an image forming process of forming a toner image on a sheet fed from the feeding unit 20. The image forming unit 30 includes a photoconductive drum 31 (referred to as an image bearing member), and a charger 32, an exposure device (not shown in FIG. 1), a developing device 33, a transfer roller 34 and a cleaner 35 arranged around the photoconductive drum 31.

The photoconductive drum 31 rotates about its shaft and has an electrostatic latent image and a toner image formed on its circumference surface. A photoconductive drum made of an amorphous silicon (a-Si) material can be used as the photoconductive drum 31. The charger 32 uniformly charges the circumferential surface of the photoconductive drum 31 and includes a charging roller held in contact with the photoconductive drum 31. The exposure device includes a laser light source and optical devices such as mirrors and lenses and forms an electrostatic latent image by irradiating the circumferential surface of the photoconductive drum 31 with light modulated based on image data fed from an external apparatus such as a personal computer.

The developing device 33 supplies toner to the circumferential surface of the photoconductive drum 31 to develop the electrostatic latent image on the photoconductive drum 31 and form a toner image. The developing device 33 includes a developing roller 331 for bearing the toner to be supplied to the photoconductive drum 31 and a first and a second conveying screws 332, 333 for conveying developer (toner) in a circulating manner in a developer housing 60 (see FIGS. 2 to 5; referred to as a housing main body) while agitating the developer. This developing device 33 is described in detail later.

The transfer roller 34 is a roller for transferring a toner image formed on the circumferential surface of the photoconductive drum 31 to a sheet and a nip portion is formed between the transfer roller 34 and the photoconductive drum 31. A transfer bias having a polarity opposite to that of the toner is applied to this transfer roller 34. The cleaner 35 includes a cleaning roller and the like and cleans the circumferential surface of the photoconductive drum 31 after the transfer of a toner image.

The fixing unit 40 performs a fixing process of fixing a transferred toner image to a sheet. The fixing unit 40 includes a fixing roller 41 including a heat source inside and a pressure roller 42 pressed in contact with this fixing roller 41 and forming a fixing nip portion together with the fixing roller 41. When a sheet having a toner image transferred thereto passes the fixing nip portion, the toner image is fixed to the sheet by being heated by the fixing roller 41 and pressed by the pressure roller 42.

The toner container 50 is for storing the toner to be supplied to the developing device 33. The toner container 50 includes a container main body 51 in which the toner is contained and a conveying screw 52 (referred to as a rotating member) for conveying the toner contained in the container.

Figure 6:
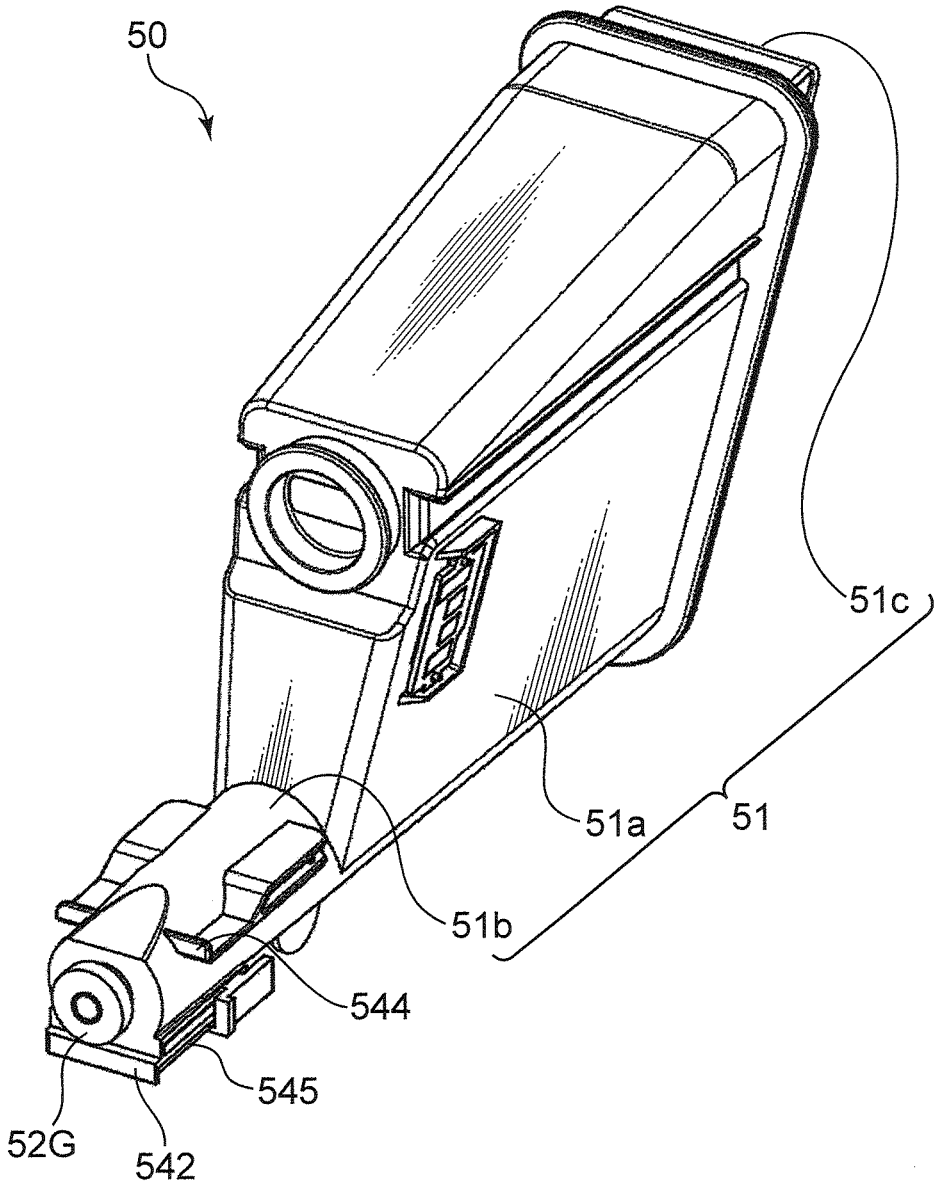
FIG. 6 is a perspective view of the toner container alone.

The container main body 51 includes a toner containing portion 51*a* in which the toner is mainly stored, a cylindrical portion 51*b* projecting from a lower part of one side surface (rear surface in FIG. 1) of this toner containing portion 51*a*, and a lid member 51*c* for covering another side surface of the toner containing portion 51*a* (see FIG. 6). The conveying screw 52 includes a shaft 521 extending in an arrangement direction of the toner containing portion 51*a* and the cylindrical portion 51*b* and a blade portion 522 spirally projecting on the outer periphery of this shaft 521. The toner stored in the toner container 50 is conveyed from the toner containing portion 51*a* to the cylindrical portion 51*b* by driving and rotating the conveying screw 52 and supplied into the developing device 33 through a toner discharge opening 511 provided in the lower surface of the leading end of the cylindrical portion 51*b*. The detailed construction of this toner container 50 is described in detail later.

A main conveyance path 22F and a reversing conveyance path 22B are provided in the main housing 10 to convey a sheet. The main conveyance path 22F extends from the sheet feeding portion 21A of the feeding unit 20 to a sheet discharge port 14 provided to face the sheet discharge unit 13 on the upper surface of the main housing 10 via the image forming unit 30 and the fixing unit 40. The reversing conveyance path 22B is a conveyance path for returning a sheet having one side printed to a side of the main conveyance path 22F upstream of the image forming unit 30 in the case of printing both sides of the sheet.

A pair of registration rollers 23 are arranged at a position of the main conveyance path 22F upstream of the transfer nip portion between the photoconductive drum 31 and the transfer roller 34. A sheet is temporarily stopped by the pair of registration rollers 23 and fed to the transfer nip portion at a predetermined timing for image transfer after a skew correction. A plurality of conveyor rollers for conveying a sheet are arranged at suitable positions of the main conveyance path 22F and the reversing conveyance path 22B. For example, a pair of discharge rollers 24 are arranged near the sheet discharge port 14.

The reversing conveyance path 22B is formed between the outer surface of a reversing unit 25 and the inner surface of the rear cover 12 of the main housing 10. Note that the transfer roller 34 and one of the pair of registration rollers 23 are mounted on the inner surface of the reversing unit 25. The rear cover 12 and the reversing unit 25 are respectively rotatable about an axis of a supporting point portion 121 provided at the lower ends thereof. If a sheet jam occurs in the reversing conveyance path 22B, the rear cover 12 is opened. If a sheet jam occurs in the main conveyance path 22F or if a unit including the photoconductive drum 31 or the developing device 33 is taken out, the reversing unit 25 is opened in addition to the rear cover 12.

Figure 2:
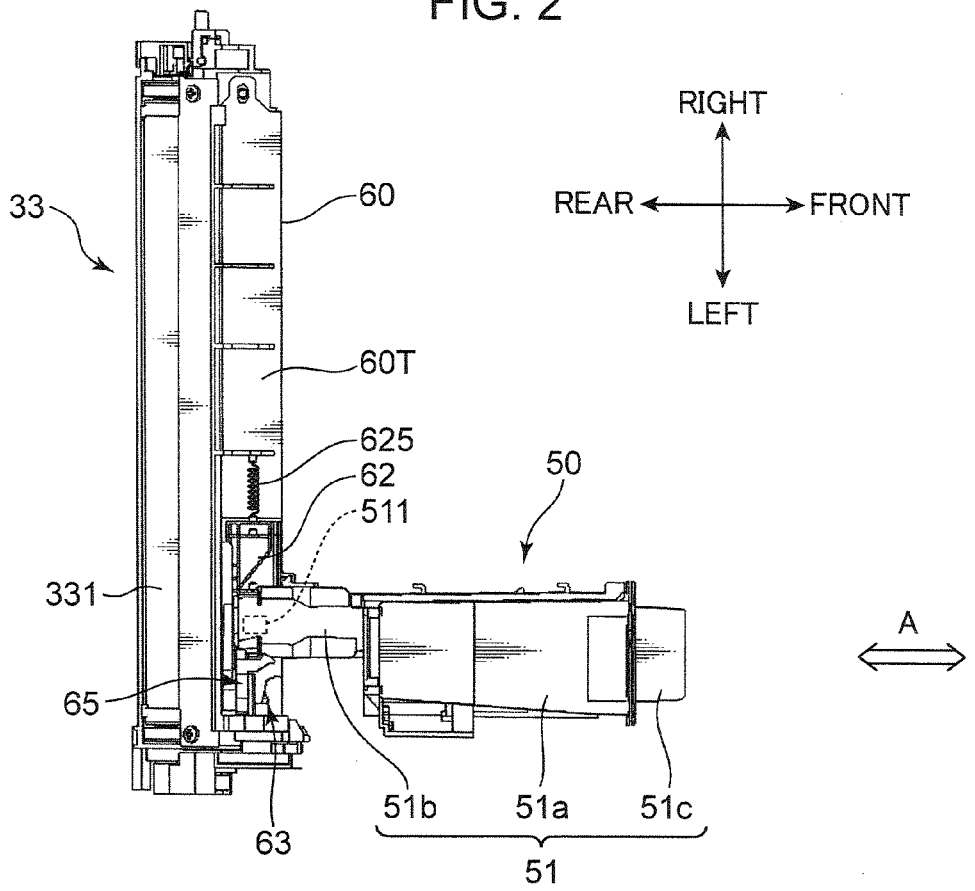
FIG. 2 is a plan view showing a developing device and a toner container incorporated in the image forming apparatus.
Figure 3:
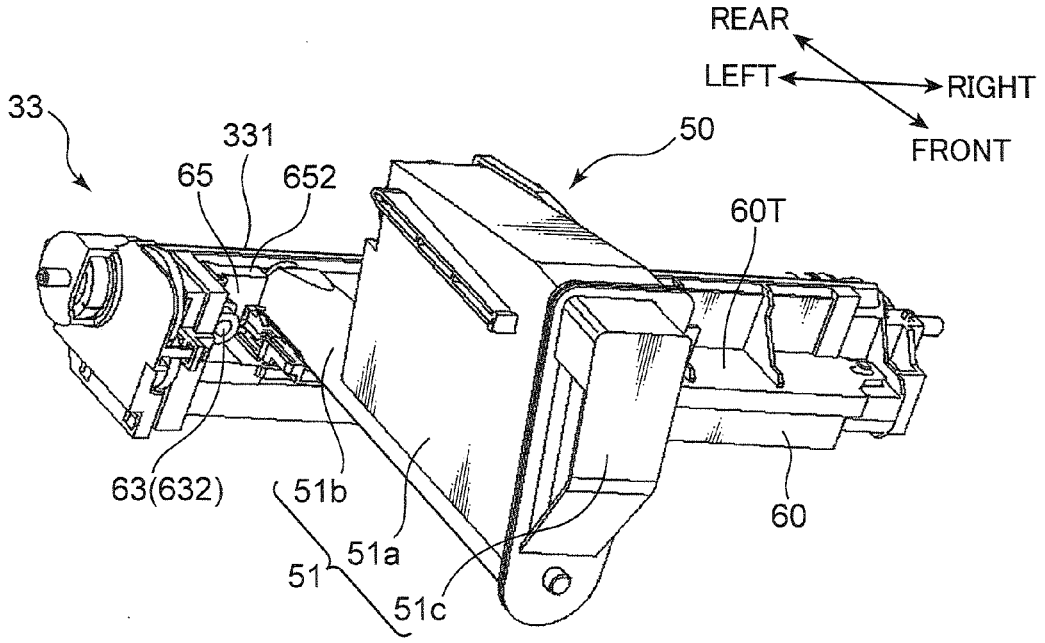
FIG. 3 is a perspective view of the developing device and the toner container shown in FIG. 2.
Figure 4:
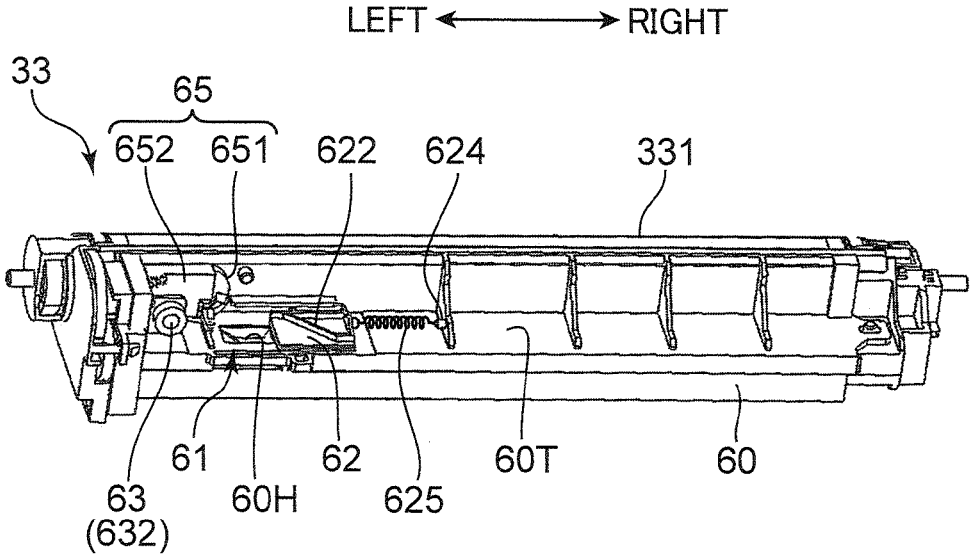
FIG. 4 is a perspective view of the developing device alone.
Figure 7:
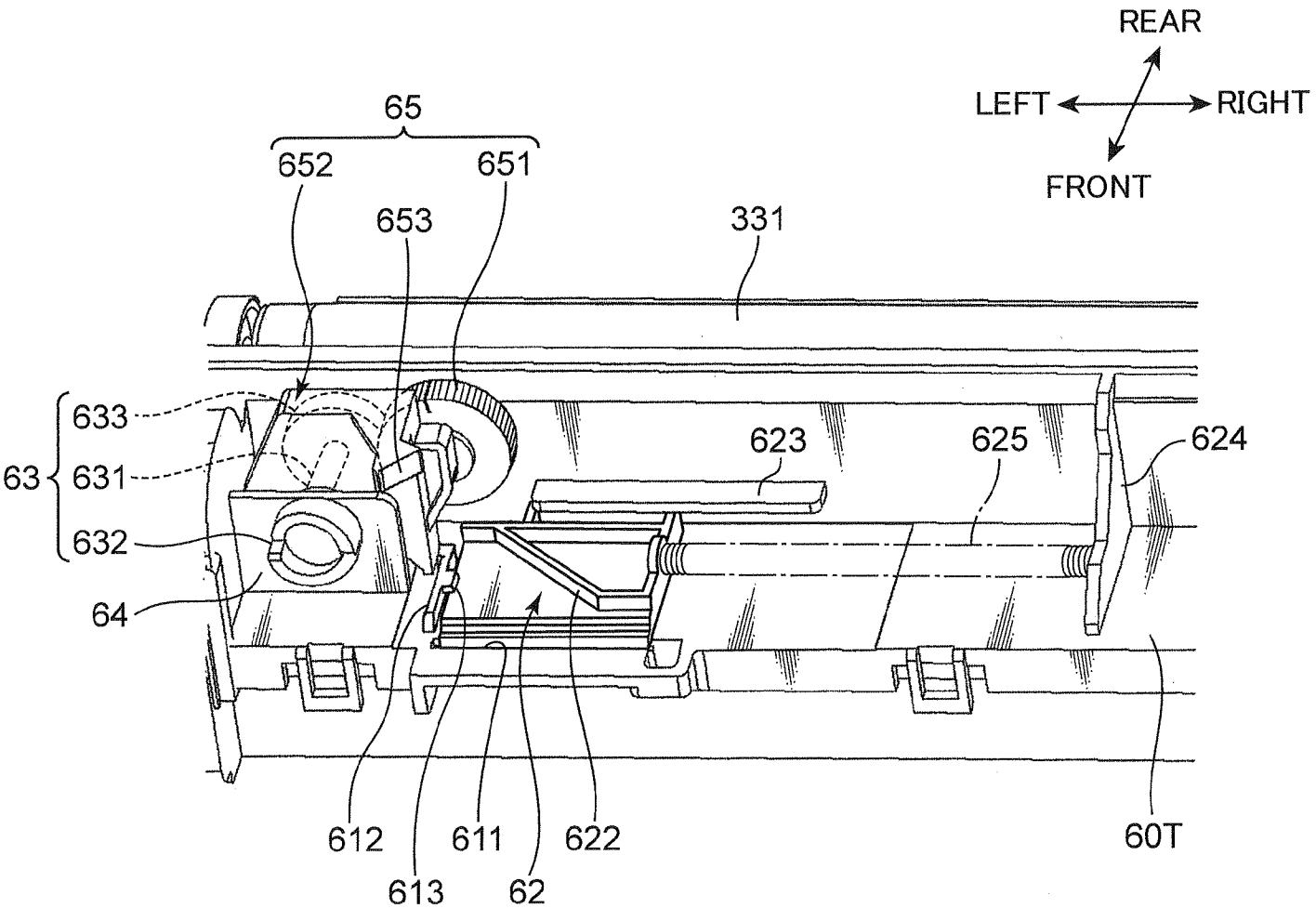
FIG. 7 is an enlarged view of an essential part of the developing device showing a container mounting portion and its vicinity (state where a developer shutter plate is at a closing position)
Figure 8:
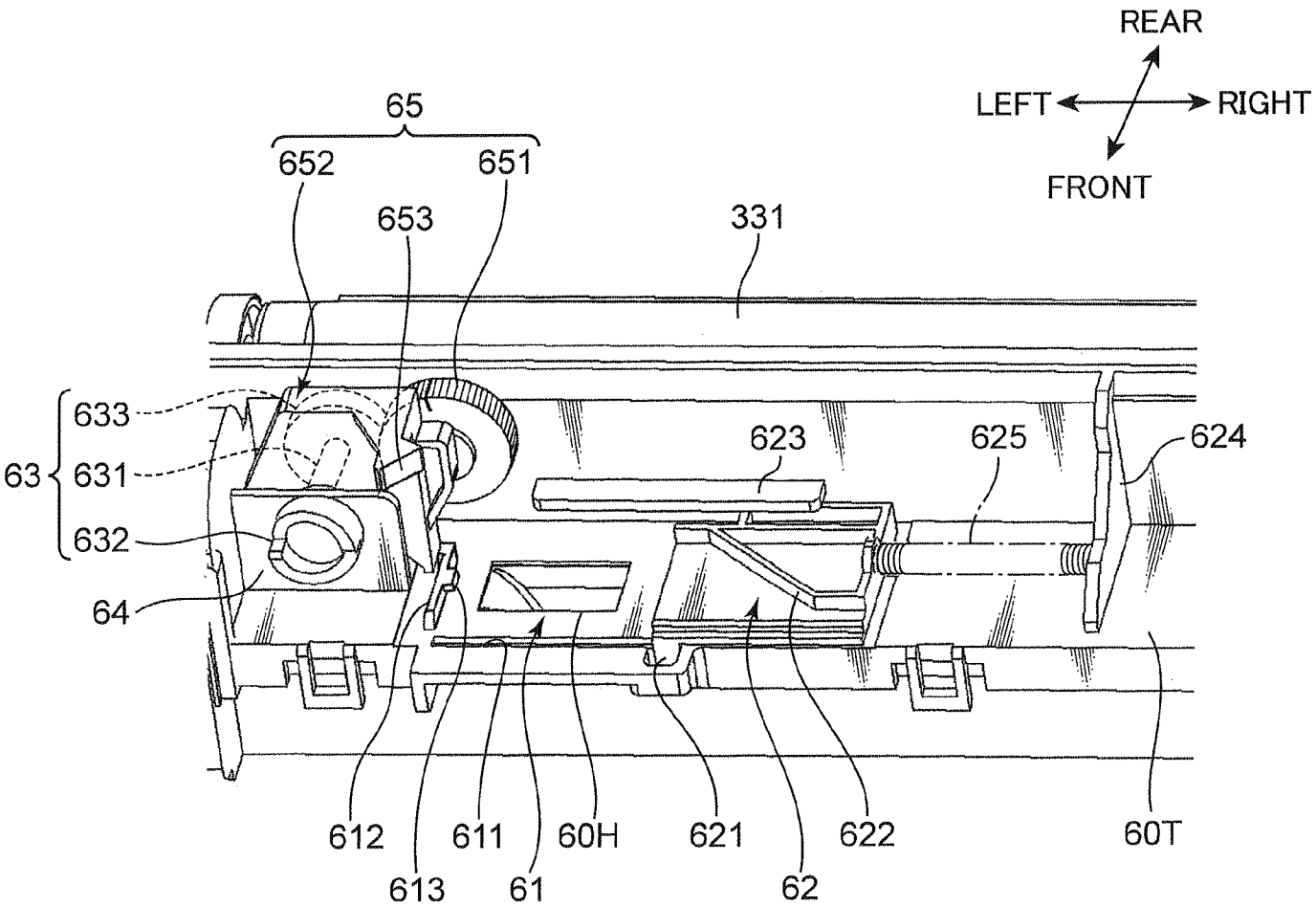
FIG. 8 is an enlarged view of the essential part of the developing device showing the container mounting portion and its vicinity (state where the developer shutter plate is at an opening position)

Next, the structures of the developing device 33 and the toner container 50 are described with reference to FIGS. 2 to 11. FIG. 2 is a plan view showing an assembled state of the developing device 33 and the toner container 50, FIG. 3 is a perspective view showing the state of FIG. 2, FIG. 4 is a perspective view of the developing device 33 alone, FIG. 5 is a plan view showing the internal structure of the developing device 33, FIG. 6 is a perspective view of the toner container 50 alone, FIGS. 7 to 9 are enlarged views of an essential part of the developing device 33, FIG. 10 is an enlarged view of an essential part of the developing device 33 and the toner container 50 showing a state where the toner container 50 is assembled with the developing device 33, and FIG. 11 are diagrams of the developing device 33 and the toner container 50 respectively showing a process of assembling the toner container 50 with the developing device 33.

The developing device 33 includes the developer housing 60 having a box shape long in one direction (axial direction of the developing roller 331). The developer housing 60 includes an opening extending in a longitudinal direction thereof, and a part of the circumferential surface of the developing roller 331 is exposed through this opening. In this embodiment, the developer housing 60 is so assembled into the main housing 10 that the longitudinal direction thereof is aligned with a lateral direction of the main housing 10.

Figure 5:
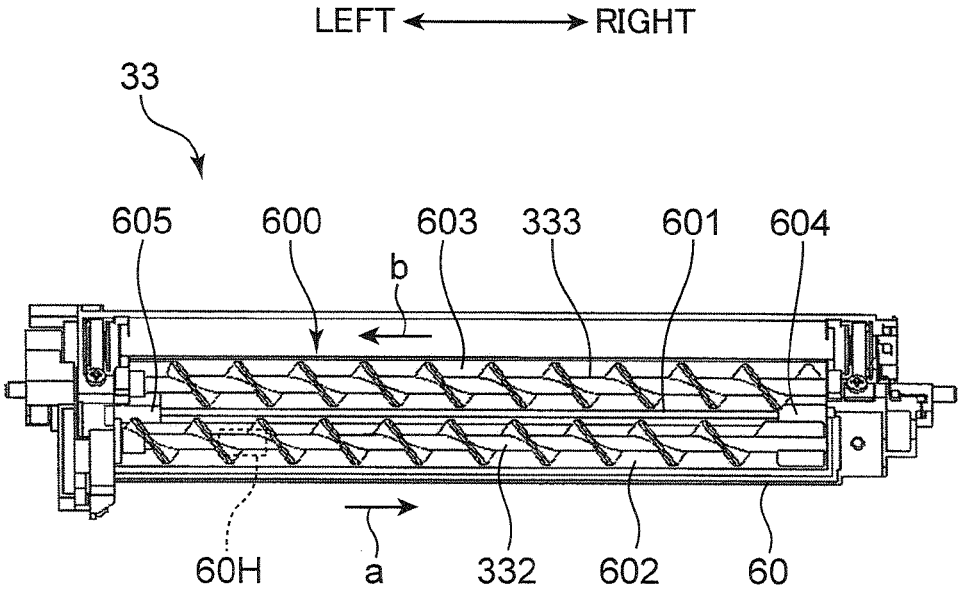
FIG. 5 is a plan view showing the internal structure of the developing device.

With reference to FIG. 5, the developer housing 60 includes an internal space 600. In the case of a two-component developing method, developer composed of toner and carrier is filled in this internal space 600. The carrier is agitated and mixed with the toner in the internal space 600, thereby charging the toner and conveying the toner to the developing roller 331. The toner is successively supplied to the developing roller 331 to be consumed, and the amount of the toner corresponding to the consumed amount is appropriately supplied from the toner container 50.

The internal space 600 of the developer housing 60 is partitioned into a first passage 602 and a second passage 603 long in the lateral direction by a partition plate 601 extending in the lateral direction. The partition plate 601 is shorter than the width of the developer housing 60 in the lateral direction, and a first communicating portion 604 and a second communicating portion 605 for allowing the first passage 602 and the second passage 603 to communicate are provided at the right and left ends of the partition plate 601. In this way, a circulation path composed of the first passage 602, the first communicating portion 604, the second passage 603 and the second communicating portion 605 is formed in the developer housing 60.

The first conveying screw 332 is housed in the first passage 602, and the second conveying screw 333 is housed in the second passage 603. Each of the first and second conveying screws 332, 333 includes a shaft and a blade portion spirally projecting on the outer periphery of this shaft. The first conveying screw 332 is driven and rotated about the shaft, thereby conveying the developer in a direction of an arrow "a" of FIG. 5. On the other hand, the second conveying screw 333 is driven and rotated about the shaft, thereby conveying the developer in a direction of an arrow "b". Accordingly, the developer is conveyed in a circulating manner along the above circulation path by driving and rotating the first and second conveying screws 332, 333.

With reference to FIGS. 4 and 7, a container mounting portion 61 is provided near the left end of a ceiling plate 60T of the developer housing 60. This container mounting portion 61 is perforated with a toner supply opening 60H used to receive the toner supplied from the toner container 50 into this housing 60, and this toner supply opening 60H and the toner discharge opening 511 of the toner container 50 are aligned in a vertical direction with the toner container 50 mounted to the container mounting portion 61.

The toner supply opening 60H is located above the vicinity of the left end of the first passage 602 of the developer housing 60. Accordingly, the toner newly supplied through the toner supply opening 60H falls down to the first passage 602, is mixed with the existing developer and conveyed in the direction of the arrow "a" by the first conveying screw 332. At this time, the toner is agitated with the carrier to be charged. Subsequently, the toner reaches the second passage 603 from the downstream end of the first passage 602 via the first communicating portion 604 and is conveyed in the direction of the arrow "b" by the second conveying screw 333. During this conveyance, the toner is similarly charged and, on the other hand, a part thereof is supplied to the circumferential surface of the developing roller 331. The remaining toner and the carrier are returned to the upstream end of the first passage 602 via the second communicating portion 605.

A developer shutter plate 62 slidable in the lateral direction is arranged on the upper surface of the ceiling plate 60T of the developer housing 60. The developer shutter plate 62 is located on the container mounting portion 61 and slidable to a closing position for closing the toner supply opening 60H by covering the toner supply opening 60H (position shown in FIG. 7) and an opening position reached by moving rightward from the closing position to open the toner supply opening 60H (position shown in FIGS. 4 and 8).

The developer shutter plate 62 includes a guiding projection 621 projecting downward. This guiding projection 621 is inserted in a slit-like guide groove 611 formed in the ceiling plate 60T and extending in the lateral direction. Further, the ceiling plate 60T is formed with a rib 623 extending in the lateral direction and covering a part of the developer shutter plate 62 from above. In this way, the developer shutter plate 62 stably slides in the lateral direction along the guide groove 611 while being pressed by the rib 623 from above.

The developer shutter plate 62 is constantly biased leftward, i.e. to be located at the closing position by a biasing spring 625. The biasing spring 625 is a coil spring and the respective ends thereof are mounted on unillustrated spring seats provided on the right end edge of the developer shutter plate 62 and a rib 624 adjacent to the developer shutter plate 62.

An oblique elongated projection 622 inclined in an oblique direction with respect to forward and backward directions is provided on the upper surface of the developer shutter plate 62. This oblique elongated projection 622 translates an external force applied to this oblique elongated projection 622 from the front side into a thrust force for moving the developer shutter plate 62 rightward.

A guiding portion 612 of the toner container 50 is arranged on the left side of the container mounting portion 61 of the developer housing 60. The guiding portion 612 guides the toner container 50 at the time of mounting the toner container 50 to the container mounting portion 61, and is composed of an elongated projection projecting from the upper surface of the ceiling plate 60T of the developer housing 60 and extending in forward and backward directions.

A shaft member 63, a gear holder 65 (referred to as a movable member) and a biasing spring 68 (referred to as a biasing member) for transmitting a rotational drive force from an unillustrated motor to the toner container 50 are further arranged to the left of this guiding portion 612.

The shaft member 63 includes a rotary shaft 631 which extends in forward and backward directions and is rotatably supported in a supporting portion 64 arranged on the ceiling plate 60T, a coupling 632 (referred to as an input portion) which is fixed to one end (front side in FIG. 7) of this rotary shaft 631 and to which the rotational drive force from the motor is given, and an intermediate gear 633 (referred to as an output portion) which is a spur gear fixed to the other end of the rotary shaft 631.

The gear holder 65 includes a holder main body 652 which is pivotably supported on the rotary shaft 631 of the shaft member 63, and an output gear 651 (referred to as an output gear) which is a spur gear rotatably supported on the holder main body 652 while being engaged with the intermediate gear 633. The gear holder 65 is pivotable to an engaged position (shown in FIGS. 7 and 10; referred to as a first position) where the output gear 651 is engaged with a later-described container gear 52G of the toner container 50 mounted to the container mounting portion 61 and a retracted position (position shown in FIG. 9A; referred to as a second position) where the output gear 651 is retracted outward (leftward) from the engaged position. The gear holder 65 is biased by a biasing spring to be constantly located at the engaged position. This biasing spring is a torsion coil spring (68) as shown in FIG. 9B and mounted on the rotary shaft 631 at a position between the supporting portion 64 and the gear holder 65, and both ends (68*a*, 68*b*) thereof are engaged with the supporting portion 64 and the holder main body 652.

Note that the output gear 651 of the gear holder 65 and the intermediate gear 633 of the shaft member 63 decelerate the rotational speed of the rotational drive force given from the motor to the shaft member 63 to a predetermined rotational speed to be applied to the toner container 50.

The holder main body 652 of the gear holder 65 is formed with a contact portion 653 (referred to as a movable member side contact portion) with which the toner container 50 comes into contact at the time of mounting the toner container 50 to the container mounting portion 61. This contact portion 653 has a contact surface inclined in an oblique direction with respect to forward and backward directions so that an external force given to the contact portion 653 from the front side can be translated into a leftward (leftward when viewed from front) rotational force of the gear holder 65, i.e. a force for displaying the gear holder 65 from the engaged position (first position shown in FIGS. 7 and 10) to the retracted position (second position shown in FIG. 9A).

The toner container 50 is assembled with the developing device 33 from the side of the cylindrical portion 51*b* along a direction (forward and backward directions/assembling direction) perpendicular to a longitudinal direction of the developer housing as shown by an arrow A in FIG. 2 with the toner containing portion 51*a* and the cylindrical portion 51*b* arranged in forward and backward directions. Accordingly, with the toner container 50 mounted to the developing device 33, the toner in the container is supplied to the developing device 33 while being conveyed from the front side to the rear side as the conveying screw 52 is rotated.

A first pressing plate 542 for pressing the developer shutter plate 62 of the developer housing 60 is mounted on a lower part of the leading end edge of the cylindrical portion 51*b* of the toner container 50, and a second pressing plate 544 (referred to as a container side contact portion) for pressing the holder main body 652 of the gear holder 65 is mounted on the left side of the cylindrical portion 51*b* slightly behind the leading end of the cylindrical portion 51*b*. Further, the container gear 52G (referred to as an input gear) which is a spur gear used to input the rotational drive force to the conveying screw 52 is arranged and exposed on the leading end surface of the cylindrical portion 51*b*. This container gear 52G is arranged on the same axial line as the shaft 521 (FIG. 1) of the conveying screw 52 and coupled to the leading end of the shaft 521 so as to be integrally rotatable with the shaft 521.

In mounting the toner container 50 to the developing device 33, the user inserts the toner container 50 into the image forming apparatus 1 from front and assembles it with the container mounting portion 61 of the developer housing 60. At this time, the user inserts a projection 613 formed on the guiding portion 612 into a groove portion 545 (see FIG. 6) formed at a lateral portion of the cylindrical portion 51*b* and inserts the toner container 50 to a predetermined assembled position along the guiding portion 612.

Figure 9A:
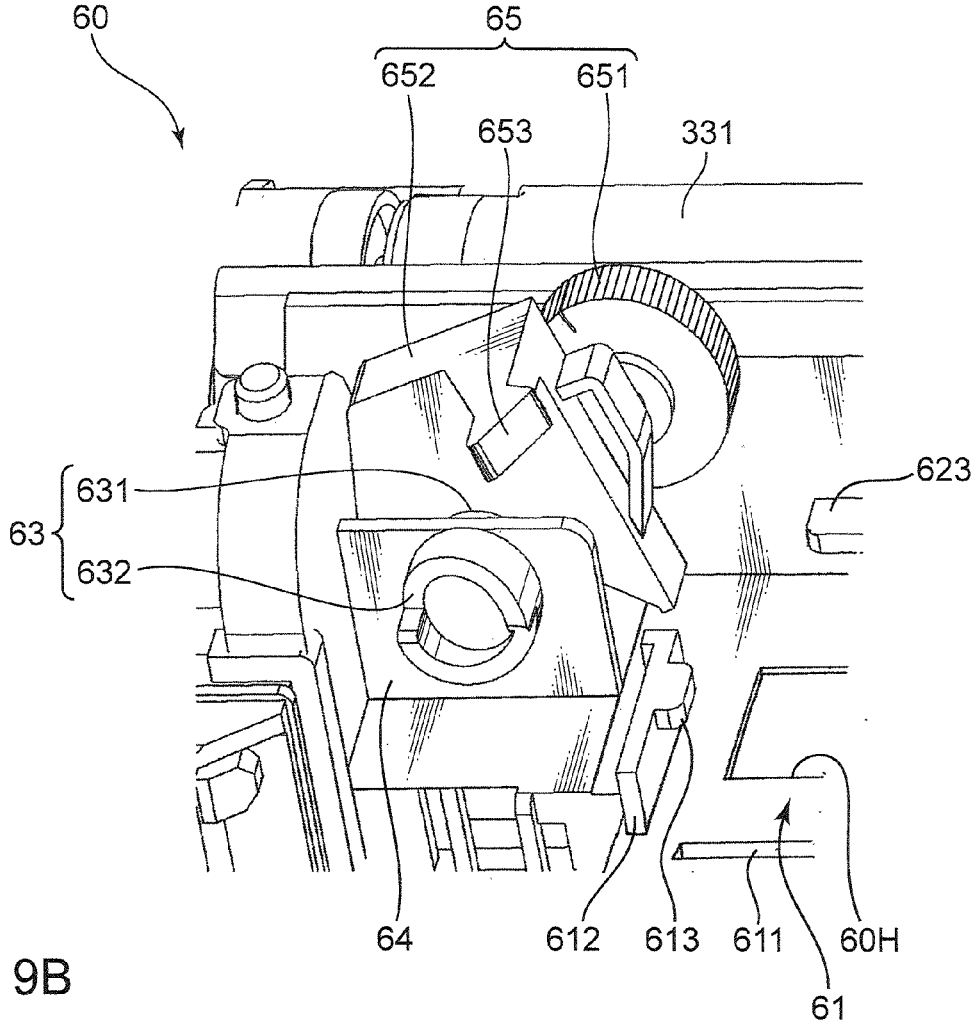
FIG. 9A is an enlarged view of an essential part of the developing device showing a state where a gear holder is at a retracted position and FIG. 9B is a view showing a state of a biasing member which biases the gear holder toward a first position.
Figure 9B:
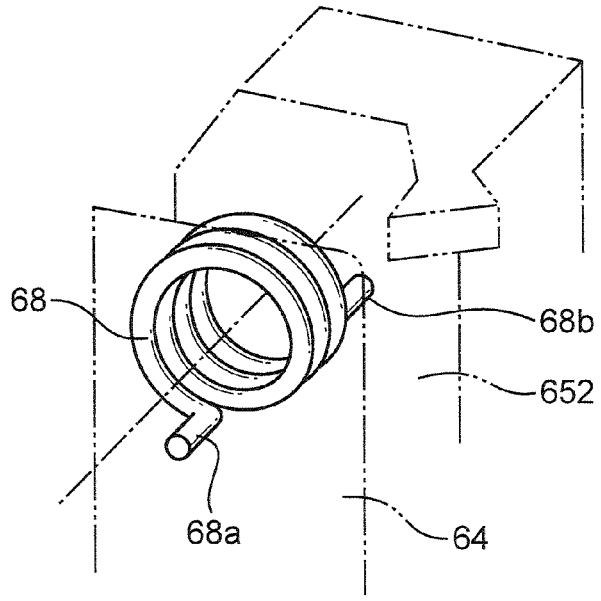
Figure 10:
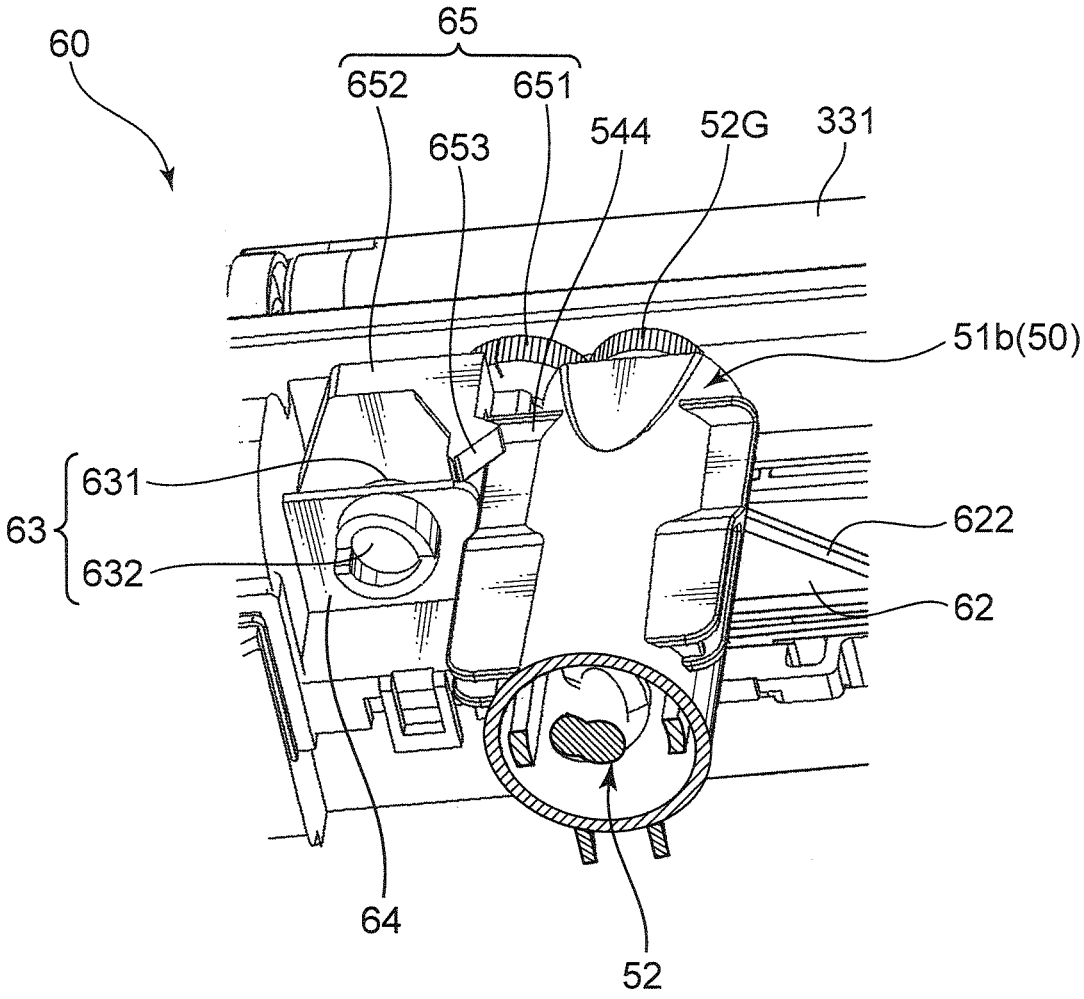
FIG. 10 is an enlarged view showing an essential part of the developing device and the toner container showing a state where the toner container is assembled, and FIG. 11 are diagrams of the developing device and the toner container showing a process of assembling the toner container with the developing device (displaced state of the developer shutter plate).

When being inserted into the container mounting portion 61 from the front side to the rear side, the cylindrical portion 51*b* of the toner container 50 interferes with the gear holder 65 arranged at the engaged position and the gear holder 65 is moved to the retracted position (see FIG. 9A; toner container 50 is not shown in FIG. 9A). Specifically, the second pressing plate 544 comes into contact with the contact surface of the contact portion 653 from front, whereby the gear holder 65 rotates to the left (to the left when viewed from front) about the rotary shaft 631 of the gear holder 65 against a biasing force of the biasing spring. In this way, the interference of the container gear 52G on the leading end of the cylindrical portion 51*b* and the output gear 651 of the developing device 33 is avoided.

When the toner container 50 is inserted to the predetermined assembled position, the second pressing plate 544 passes the position of the contact portion 653 as shown in FIG. 10, whereby a contact state of the second pressing plate 544 and the contact portion 653 is released and the gear holder 65 returns to the engaged position by the biasing force of the biasing spring. In this way, the output gear 651 is engaged with the container gear 52G and the rotational drive force can be transmitted from the developing device 33 to the toner container 50.

Figure 11A:
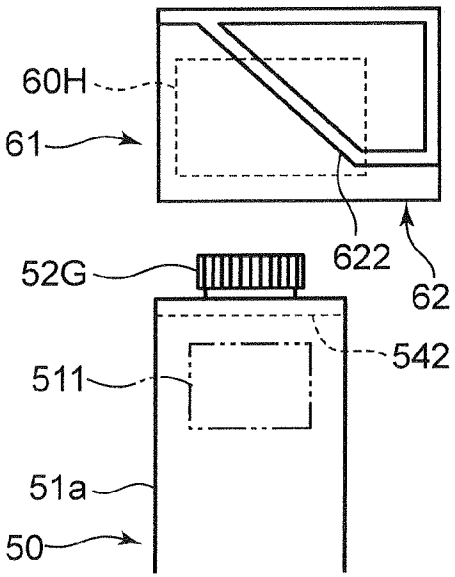
Figure 11B:
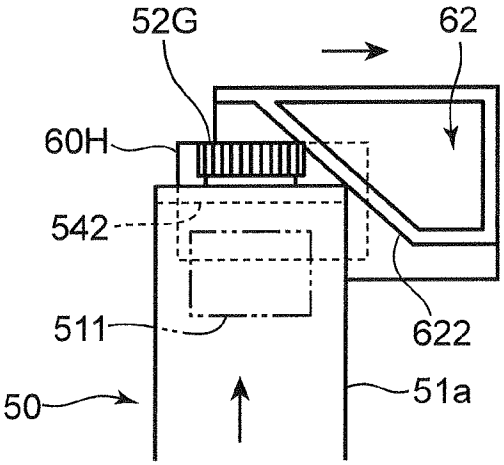
Figure 11C:
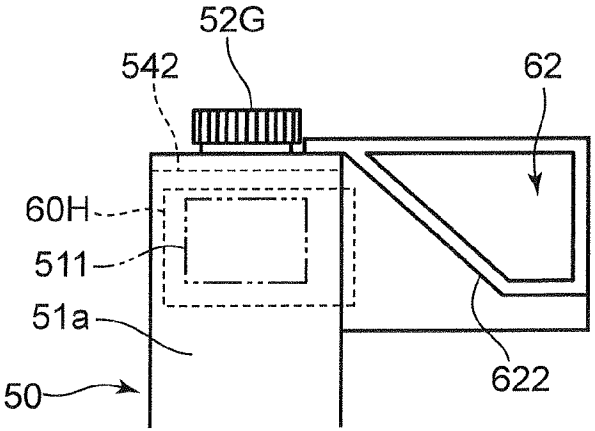

On the other hand, when the cylindrical portion 51*b* of the toner container 50 is inserted into the container mounting portion 61 from the front side to the rear side, the first pressing plate 542 of the toner container 50 interferes with the developer shutter plate 62 arranged at the closing position to move the developer shutter plate 62 rightward. Specifically, as shown in FIGS. 11A and 11B, the first pressing plate 542 comes into contact with the oblique elongated projection 623 projecting on the upper surface of the developer shutter plate 62 to push the developer shutter plate 62 rightward against the biasing force of the biasing spring 625. When the toner container 50 is inserted to the predetermined assembled position (FIG. 11C), the developer shutter plate 62 reaches the opening position to open the toner supply opening 60H and the toner discharge opening 511 of the toner container 50 faces the toner supply opening 60H, whereby the toner can be supplied from the toner container 50 to the developing device 33. Note that although not shown, the toner container 50 includes a shutter member for opening and closing the toner discharge opening 511, and this shutter member is pushed forward by the projection 613 formed on the guiding portion 612 to thereby open the toner discharge opening 511 as the cylindrical portion 51*b* of the toner container 50 is inserted from the front side to the rear side in mounting the toner container 50.

On the other hand, when the toner container 50 is removed from the container mounting portion 61, the developer shutter plate 62 returns to the closing position by the biasing force of the biasing spring 625, thereby closing the toner supply opening 60H.

As described above, in this image forming apparatus 1, the rotational drive force is transmitted from the developing device 33 to the toner container 50 by assembling the toner container 50 with the developing device 33 from front and engaging the container gear 52G of the toner container 50 and the output gear 651 of the developing device 33. As described above, in assembling the toner container 50 with the developing device 33, the gear holder 65 moves from the engaged position to the retracted position as the toner container 50 is inserted into the container mounting portion 61, whereby the interference of the container gear 52G and the output gear 651 is avoided. When the toner container 50 reaches the predetermined assembled position, the gear holder 65 returns to the engaged position and the output gear 651 is engaged with the container gear 52G, thereby enabling the transmission of the rotational drive force from the developing device 33 to the toner container 50. Thus, according to this image forming apparatus 1, it is possible to quickly assemble the toner container 50 with the developing device 33 while avoiding the interference of the container gear 52G and the output gear 651 and prevent the damage of the both gears 52G, 651 caused by the interference.

Particularly, in this image forming apparatus 1, the gear holder 65 is rotatably supported on the shaft member 63 (rotary shaft 631) that receives the rotational drive force from the motor and is displaced to the position where the output gear 651 is engageable with the container gear 52G and the position retracted outward from this position as being rotated. That is, this image forming apparatus 1 does not require a special supporting shaft for rotatably supporting the gear holder 65 while allowing the output gear 651 and the gear holder 65 to be rotationally displaced together, and a rational configuration is achieved in which the shaft member 63 doubles as the supporting shaft. Further, since the output gear 651 is rotationally displaced with a distance between the shaft member 63 (rotary shaft 631) and the output gear 651 kept constant, there is an advantage of being able to transmit the rotational drive force from the shaft member 63 to the output gear 651 by a simple configuration of providing the intermediate gear 633 on the shaft member 63 as in the above embodiment while displacing the output gear 651.

Although the image forming apparatus 1 according to the embodiment of the present disclosure has been described above, the following modifications can be, for example, made without being limited to this.

(1) Although the output gear 651 is displaced along an arcuate path centered on the shaft member 63 by rotating the gear holder 65 in the above embodiment, it may be linearly displaced in the lateral direction. An example of such a case is thought to be a structure in which a transmission member integrally including elements equivalent to the shaft member 63 and the gear holder 65 is arranged in the developer housing 60 and is displaced in the lateral direction according to an inserting movement of the toner container 50 in the same manner as the developer shutter plate 62 is.

(2) Although the intermediate gear 633 of the shaft member 63 is engaged with the output gear 651 in the above embodiment, one or more gears interposed between the intermediate gear 633 and the output gear 651 for transmitting the rotational drive force may be provided in the holder main body 652.

(3) Although the rotational drive force is transmitted from the shaft member 63 to the output gear 651 by fixing the intermediate gear 633 as an output portion of the present disclosure to the shaft member 63, i.e. by a so-called gear transmission mechanism, a transmission mechanism for the rotational drive force may be a belt transmission mechanism without being limited to the gear transmission mechanism. For example, an output gear with a pulley may be provided as the output gear 651, a pulley may be fixed as the output portion of the present disclosure to the shaft member 63, and a rotational drive force may be transmitted from the shaft member 63 to the output gear 651 by mounting a transmission belt between these pulleys.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising an image bearing member for bearing a toner image on a circumferential surface, a developing device including a developing roller for supplying toner to the circumferential surface of the image bearing member, and a toner container to be removably assembled with the developing device for supplying toner to the developing device, wherein:

the toner container is assembled with the developing device along an assembling direction perpendicular to an axial direction of the developing roller and the toner container includes:

a container main body in which the toner is contained, a rotating member which is arranged in the container main body and rotatably supported in the container main body, and an input gear which is provided rotatably about an axis parallel to the assembling direction and to which a rotational drive force for rotating the rotating member is to be input;

the developing device includes:

a housing main body in which the developing roller is housed, a container mounting portion which is arranged on the housing main body and to which the toner container is to be mounted, a movable member which includes an output gear which rotates about an axis parallel to the assembling direction upon receiving a rotational drive force from outside and is so supported on the housing main body as to be displaceable to a first position where the input gear and the output gear are engageable and a second position retracted outward from the first position, and a biasing member which biases the movable member to the first position;

the container main body includes a container side contact portion, the movable member includes a movable member side contact portion, and the container side contact portion comes into contact with the movable member side contact portion in a mounting process of mounting the toner container to the container mounting portion of the developing device;

the container side contact portion comes into contact with the movable member side contact portion in the mounting process, thereby displacing the movable member from the first position to the second position against a biasing force of the biasing member as the toner container moves in the assembling direction; and when the toner container reaches a predetermined assembled position, a contact state of the container side contact portion and the movable member side contact portion is released, whereby the movable member is returned to the first position by the biasing force of the biasing member.

2. An image forming apparatus according to claim 1, wherein;

the movable member is so supported on the developing device as to be rotatable about the axis parallel to the assembling direction and is displaced to the first position and the second position through this rotation.

3. An image forming apparatus according to claim 2, wherein:

the developing device includes the shaft member, the shaft member including:

a rotary shaft which is so supported in the housing main body as to be rotatable about an axis parallel to the assembling direction, an input portion to which a rotational drive force for rotating the rotary shaft is to be input, and an output portion for giving the rotational drive force input to the rotary shaft as a rotational drive force from the outside to the output gear; and the movable member is rotatably supported on the rotary shaft of the shaft member.

4. An image forming apparatus according to claim 3, wherein:

the output portion includes a gear engaged with the output gear; and the shaft member and the output gear transmit the rotational drive force given to the input portion to the input gear while decelerating the rotational speed thereof to a predetermined rotational speed.

5. An image forming apparatus according to claim 1, wherein:

the container main body includes a toner discharge opening at a predetermined position on the inner bottom surface thereof;

the rotating member includes:

a rotary shaft which extends in the assembling direction and is rotatably supported in the container main body with the toner container assembled with the developing device, and a blade portion which is arranged on the outer periphery of the rotary shaft and integrally rotated with the rotary shaft, thereby moving the toner to the toner discharge opening along the rotary shaft; and the input gear is so coupled to an end of the rotary shaft of the rotating member as to be integrally rotatable with the rotary shaft.

6. An assembly, comprising: a developing device and a toner container configured to supply toner to the developing device, the developing device including:

a developing roller for supplying toner to a circumferential surface of an image bearing member bearing a toner image on the circumferential surface, the toner container being removably mountable to the developing device along an assembling direction perpendicular to an axial direction of the developing roller;

a housing main body which includes a container mounting portion to which the toner container is to be mounted;

a movable member which includes an output gear which rotates about an axis parallel to the assembling direction upon receiving a rotational drive force from outside and is so supported on the housing main body as to be displaceable to a first position where the output gear transmits the rotational drive force to the toner container and a second position retracted outward from the first position, and a biasing member which biases the movable member to the first position;

said toner container, comprising:

a container main body in which the toner is contained;

a rotating member which is arranged in the container main body and rotatably supported in the container main body; and an input gear which is provided rotatably about an axis parallel to the assembling direction and engageable with the output gear of the movable member arranged at the first position and to which a rotational drive force for rotating the rotating member by the engagement of the input gear with the output gear is to be input from the output gear;

wherein:

the container main body includes a contact portion which comes into contact with the movable member in a mounting process of mounting the toner container to the container mounting portion;

the contact portion displaces the movable member from the first position to the second position against a biasing force of the biasing member as the toner container moves in the assembling direction in the mounting process; and when the toner container reaches a predetermined assembled position, the movable member is returned to the first position by the biasing force of the biasing member.

7. An assembly according to claim 6, wherein:

the container main body includes a toner discharge opening at a predetermined position on the inner bottom surface thereof;

the rotating member includes:

a rotary shaft which extends in the assembling direction and is rotatably supported in the container main body with the toner container assembled with the developing device, and a blade portion which is arranged on the outer periphery of the rotary shaft and integrally rotated with the rotary shaft, thereby moving the toner to the toner discharge opening along the rotary shaft; and the input gear is so coupled to an end of the rotary shaft of the rotating member as to be integrally rotatable with the rotary shaft.

* * * * *